United States Patent [19]

Wyckoff

[11] 4,011,931

[45] Mar. 15, 1977

[54] BILL ESCROW AND STORAGE APPARATUS FOR VENDING MACHINE

[75] Inventor: James Kenneth Wyckoff, San Diego, Calif.

[73] Assignee: Cubic-Western Data, San Diego, Calif.

[22] Filed: Feb. 13, 1976

[21] Appl. No.: 657,882

[52] U.S. Cl. ..... 194/4 C; 209/DIG. 2

[51] Int. Cl.[2] ..... G07F 7/04

[58] Field of Search ..... 194/4 R, 4 B, 4 C, 4 D, 194/4 E, 4 F, 4 G, 5; 209/DIG. 2

[56] References Cited

UNITED STATES PATENTS

| | | | |
|---|---|---|---|
| 3,362,515 | 1/1968 | Yamamoto et al. | 194/4 R |
| 3,924,847 | 12/1975 | Pescetto | 209/DIG. 2 |

*Primary Examiner*—Stanley H. Tollberg
*Attorney, Agent, or Firm*—Brown & Martin

[57] ABSTRACT

Apparatus for handling paper money in a vending or money changing machine, in which a validator unit either accepts or rejects an inserted bill. Each accepted bill is moved a short distance by a conveyor to a handling station, where a ram pushes the bill into an escrow box in which the bill is held until the associated transaction is completed. When the transaction is complete, the ram pushes the bill through the escrow box into a stacker or storage vault. If the transaction is not completed, the escrow box swings down and the bill is ejected for return to the donor. The operation is automatic, the mechanism being simple and adaptable to a variety of vending machines.

12 Claims, 12 Drawing Figures

BILL ESCROW AND STORAGE APPARATUS FOR VENDING MACHINE

BACKGROUND OF THE INVENTION

In vending and money changing machines, the handling of paper money is a problem due to the fact that the bills are often wrinkled, may have folded corners or edges, or even be torn. Some systems in use carry the bill through restricted tracks or paths, with multiple choice routes depending on the transaction. Damaged or folded bills tend to jam or hang up at various points, requiring frequent servicing of the machine. For prolonged service with a minimum of attention, it is necessary for the machine to handle bills with a variety of imperfections, without jamming or malfunctioning.

SUMMARY OF THE INVENTION

The apparatus described herein is capable of handling imperfect paper money without jamming and is adaptable to a variety of vending and money changing machines. Bills are fed individually into the apparatus by a validator unit, which either accepts or rejects a bill. If the bill is rejected, no further action occurs.

When a valid bill is accepted, the bill emerges from the rear of the validator unit into a short conveyor, which is started by the acceptance action. The bill is carried in an open track to a handling position and stops over an opening in the track. This action initiates a reciprocal transfer ram which pushes the bill through the opening into an escrow box below the track, where the bill is held between spring loaded platens and overlapping retaining flaps. While the machine is performing its operations the bill is held in escrow box and does not have to move through any complex mechanism, as in some machines. When the associated transaction is completed, the ram is again actuated to drive the bill through the escrow box into a stacker or storage vault.

The escrow box is mounted on hinged arms on the storage vault to swing forward and down and become inverted. At the downward limit of travel, an actuating mechanism opens the retaining flaps to release the bill from the escrow box. If a transaction is not completed, due to the supply of the desired item being exhausted, the machine being out of change, or some other reason, this action of the escrow box is initiated and the bill is returned to the donor.

The path of travel of the bill is very short, about twice its own length, through an open track, from which it is pushed through an opening in the track. There are no restricted passages or mechanisms in which the bill can become jammed.

The primary object of this invention, therefore, is to provide a new and improved bill escrow and storage apparatus.

Another object of this invention is to provide a bill escrow and storage apparatus capable of handling imperfect bills without jamming.

Another object of this invention is to provide bill escrow and storage apparatus which holds a bill in escrow until an associated transaction is completed, then stores the bill in a vault, or returns the bill if the transaction is not completed.

A further object of this invention is to provide bill escrow and storage apparatus which is adaptable to a variety of vending machines.

Other objects and advantages will be apparent in the following detailed description, taken in conjunction with the accompanying drawings, in which.

DESCRIPTION OF THE PREFERRED EMBODIMENT

Figure 1:
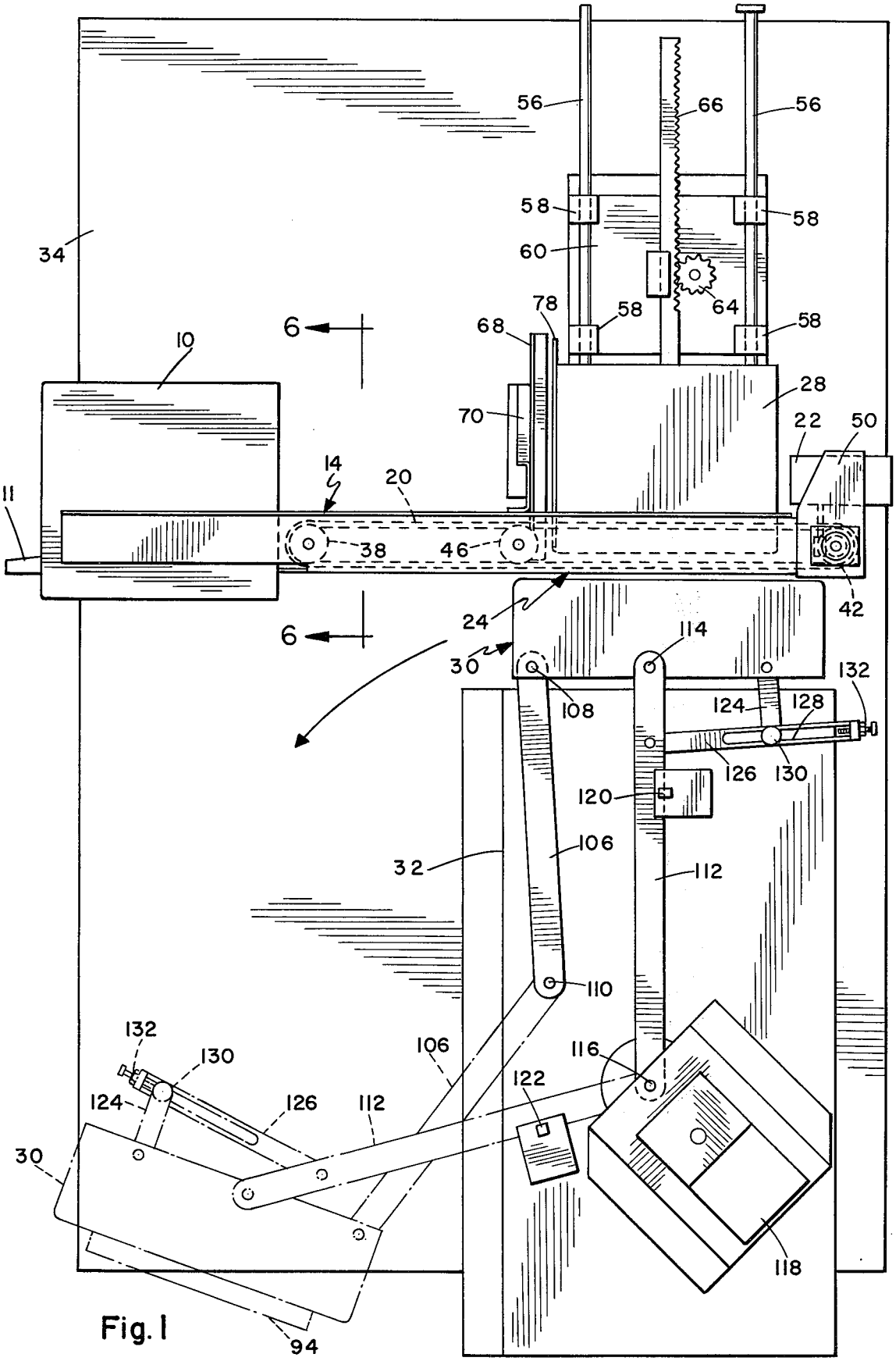
FIG. 1 is a side elevation view of the complete apparatus.
Figure 2:
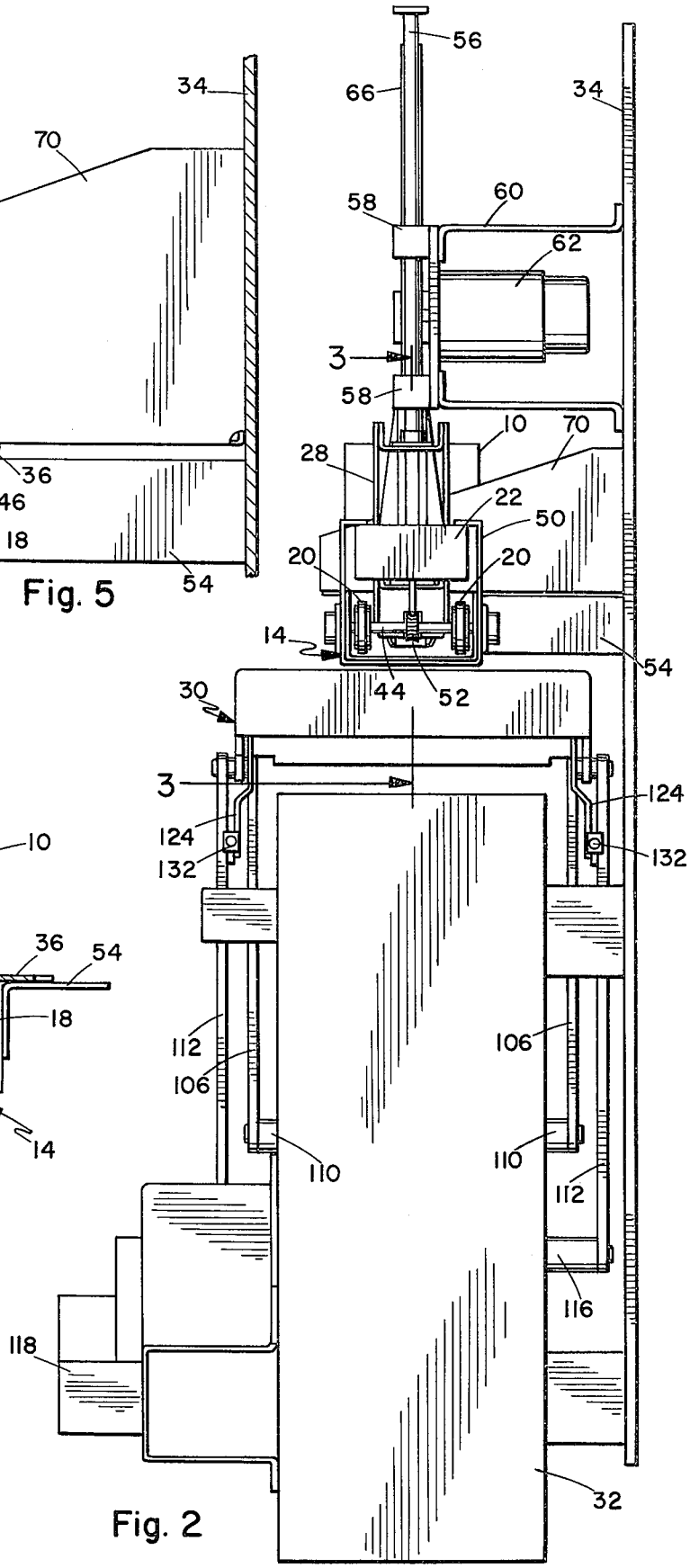
FIG. 2 is an end view as taken from the right hand side of FIG. 1.
Figure 7:
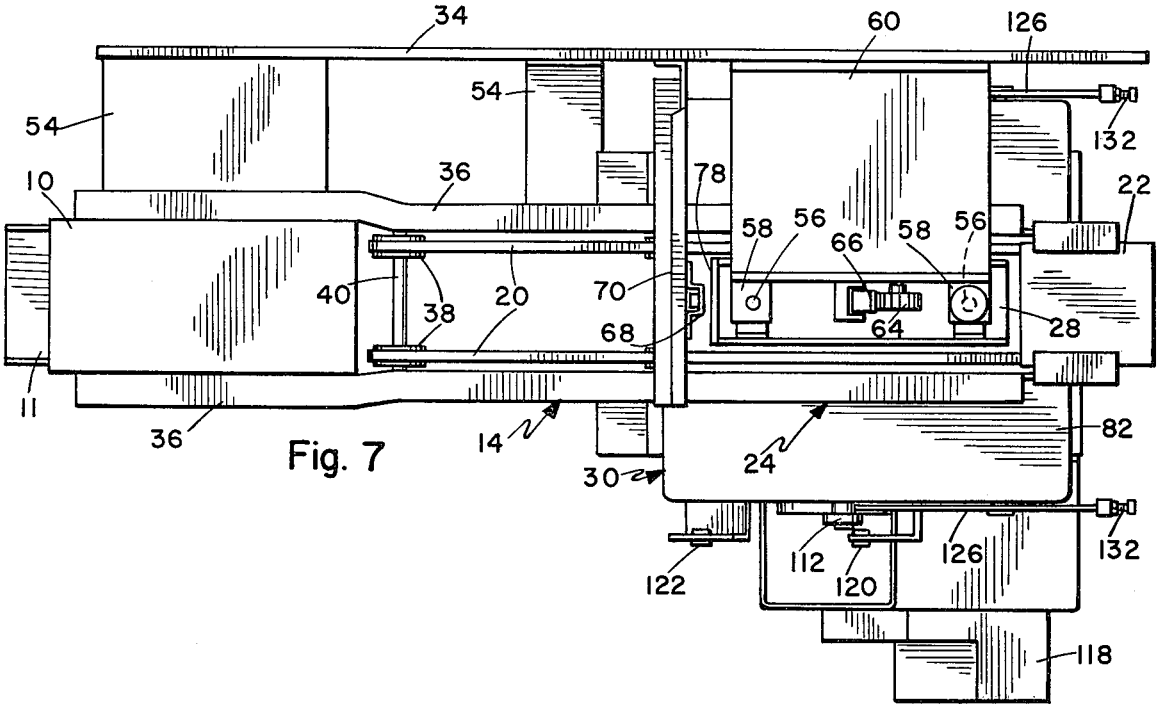
FIG. 7 is a top plan view of the complete apparatus.

The apparatus shown in its entirety in FIGS. 1, 2 and 7, includes a bill validator unit 10 of conventional type which receives paper money in specific denominations, and either accepts or rejects each bill. A rejected bill is returned through the feed chute 11 on the front of the unit, while an accepted bill is ejected through an outlet 12 at the rear.

The validator unit is mounted on the forward end of a track 14, in the form of an elongated channel of U-shaped cross section having a base 16 and side walls 18. In the track is a conveyor with endless belts 20 along opposite sides of the track, driven by a motor 22 at the rear end of the track.

Figure 5:
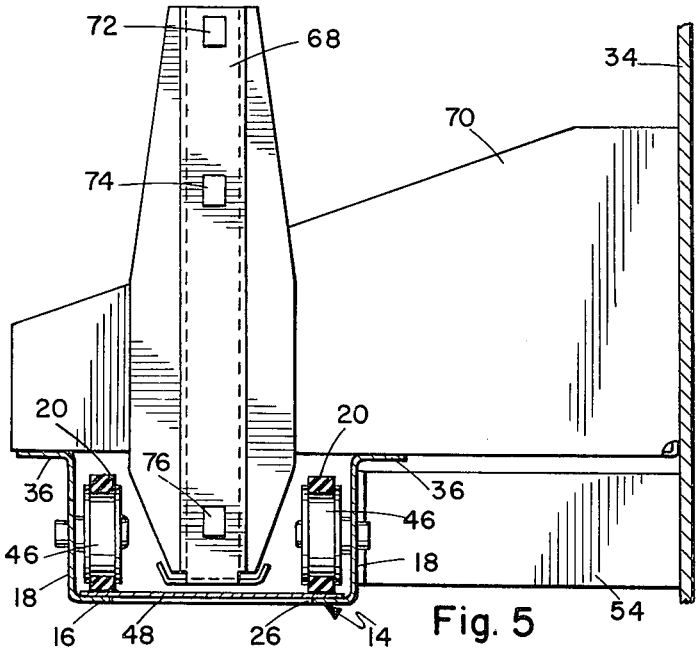
FIG. 5 is a sectional view taken on line 5—5 of FIG. 3.
Figure 6:
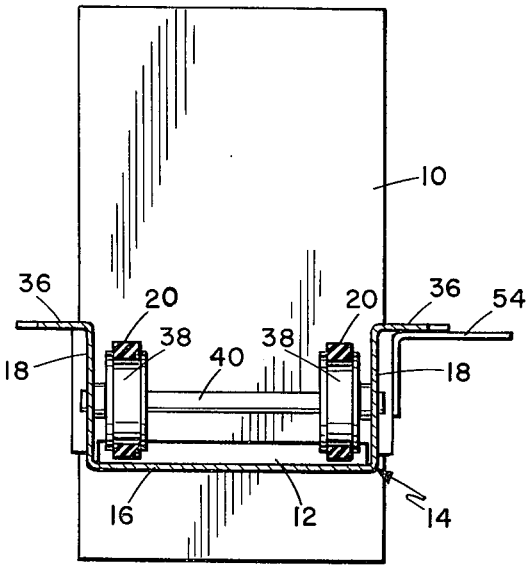
FIG. 6 is an enlarged sectional view taken on line 6—6 of FIG. 1.

The rear portion of the track 14 comprises a handling station 24, at which there is an opening 26 in base 16 of the track. Opening 26 is slightly longer than a standard bill 48, but narrower in width, so that the longitudinal edges of the bill are supported on base 16 along both sides of the opening, as in FIG. 5. Above the handling station 24 is a vertically movable transfer ram 28, which can descend through the opening 26 into an escrow box 30 below the track. The escrow box is mounted above a storage vault 32 in which the bills are stored after complete acceptance.

As illustrated, all of the structure is mounted on a panel 34, but could be attached to any suitable support structure in a specific machine in in which the apparatus is used. Side walls 18 of track 14 have outwardly turned flanges 36 along their upper edges to facilitate support and mounting of components.

Belts 20 are supported between a pair of rollers 38 on a shaft 40 at the forward end of track 14, and a pair of rollers 42 on a shaft 44 at the rear end of the track. Approximately mid way between the end rollers are intermediate rollers 46, which hold the belts down for driving contact with a bill 48 at the entry to the handling station 24. All of the rollers are journalled in any suitable manner on side walls 18. Motor 22 is mounted above the track on a bracket 50 and has a worm gear drive coupling 52 to shaft 44 to drive the belts 20. Track 14 is secured to panel 34 by suitable brackets 54.

Ram 28 is illustrated as an open box structure, but may be of any convenient construction. The ram is supported on a pair of vertical guide posts 56, which slide in bearing blocks 58 on a support frame 60 extending from panel 34. Ram 28 is reciprocally driven by a motor 62 secured on frame 60, the motor having a pinion 64 which engages a toothed rack 66 extending vertically from the ram.

Figure 3:
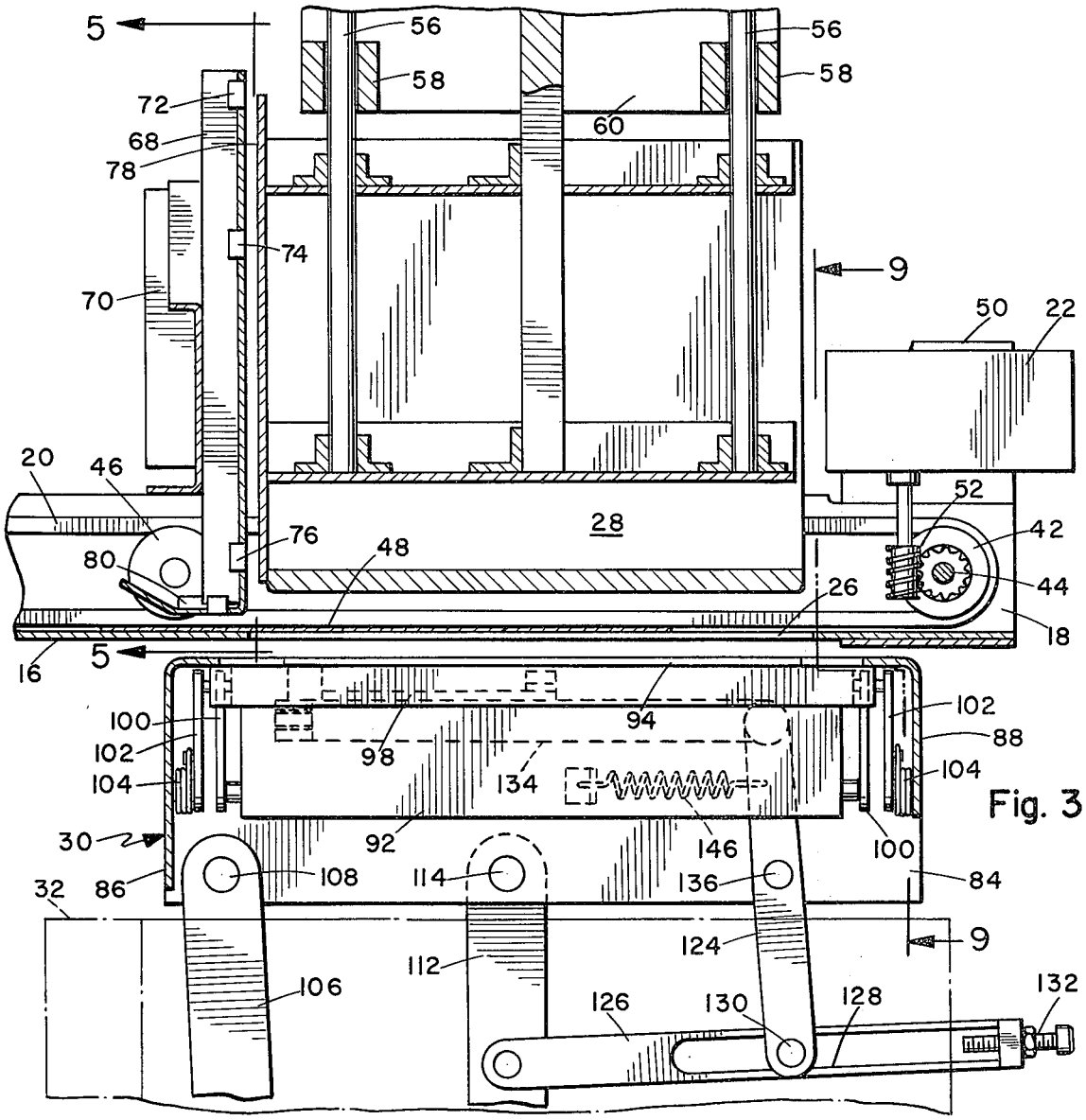
FIG. 3 is an enlarged sectional view taken on line 3—3 of FIG. 2.

Adjacent the forward end of ram 28 is an upright post 68 supported on a bracket 70 which extends from panel 34, and is also attached to track flanges 36 for rigidity. On post 68 are three vertically spaced sensors 72, 74 and 76 to detect the position of ram 28. The sensors may be of various types but are preferably photoelectric to actuate limit switches for motor 62. Such sensors are readily available and comprise a light emitting diode, or LED and photosensitive diode mounted side by side. The photosensitive diode detects light from the LED reflected from an adjacent surface or target, in this instance the front wall 78 of ram 28. When the ram moves downwardly, the reflected light is interrupted at successive detectors, the resulting signal changes being used to actuate limit switches to control the ram drive motor, the technique being well known. On the lower end of post 68 is a further sensor 80, directed toward track base 16 to detect passage of a bill 48 into the handling station, as in FIG. 3.

Escrow box 30 has a top panel 82, side walls 84, a front wall 86 and a rear wall 88, the bottom being open. In the top panel 82 is a centrally positioned rectangular opening 90 substantially larger than a bill and aligned with opening 26 in track 14. The escrow box and its internal structure and mechanism are symmetrical about the longitudinal axis of opening 90. In each side of the escrow box is an internal frame 92 to support portions of the mechanism.

Figure 8:
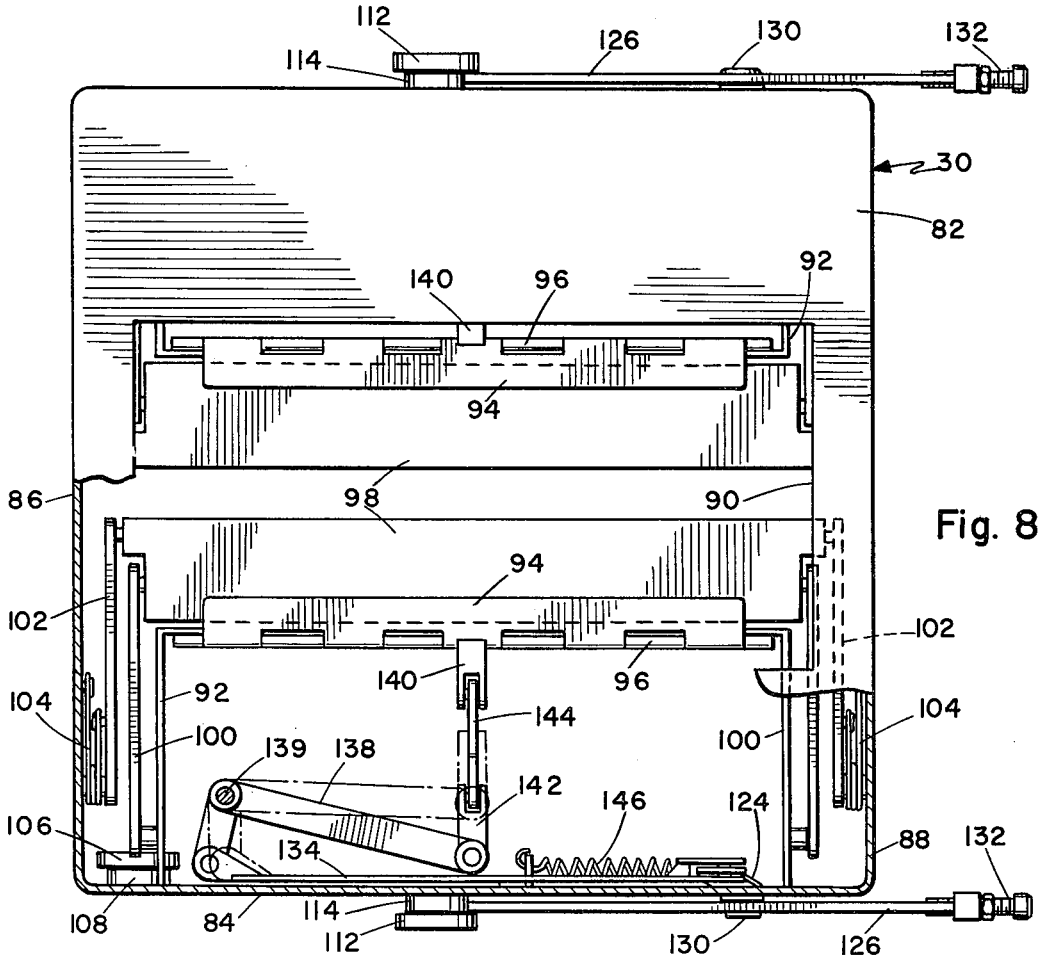
FIG. 8 is an enlarged top plan view of the escrow box, partially cut away.

Along each side of opening 90 is a retaining flap 94 attached by a hinge 96 to the respective frame 92. The flaps 94 are normally flush with the top surface of panel 82 and overlap the longitudinal edges of a bill 48 positioned in the opening. Under each flap 94 is a platen 98, pivotally mounted on staggered parallel arms 100 and 102 at each end to swing downwardly while remaining parallel to top panel 82. Arms 100 are pivotally attached to frame 92, while arms 102 are pivotally attached to front and rear walls 86 and 88, as in FIGS. 3 and 8. Arms 102 are biased by springs 104 to hold the platens 98 upwardly against the flaps 94.

Vault 32 is a box structure which may itself be a strong box or contain a box or stacking unit in which the bills are securely held for periodic collection. Escrow box 30 is mounted on the vault 32 on a pivoted arm assembly to swing forward and down from below the handling station 24. The arms include a pair of front arms 106 pivotally attached to the inside of side walls 84 adjacent front wall 86 by hinge pins 108. The front arms straddle vault 32 and the lower ends of the arms are attached to the vault by hinge pins 110. A pair of rear arms 112 are attached to the outside of side walls 84 by hinge pins 114, rearwardly of front arms 106. The lower ends of rear arms 112 are attached to vault 32 by hinge pins 116. Rear arms 112 are longer than arms 106, which are the leading arms relative to the direction of outward swinging travel, so that, when the escrow box swings forward and down, it also becomes inverted, as in the broken line position in FIG. 1.

The escrow box is actuated by a motor 118 mounted on vault 32, with any suitable drive connection to one rear arm 112. The upper position of the driven rear arm is detected by a sensor 120 and the lower position by a sensor 122, mounted on the vault to serve as or actuate limit switches for motor 118.

Pivotally attached to each side wall 84 rearwardly of the rear arm 112 is a lever 124 which extends downwardly below the escrow box. Pivotally attached to the rear arm 112 is an actuating arm 126, having a longitudinal slot 128, lever 124 having a guide pin 130 which is slidably held in the slot. On the rear end of actuating arm 126 is an adjustable stop 132. It can be seen in FIG. 1, that when the escrow box is in the lowered position, arm 112 has swing across arm 106 and pulled the actuating arm 126 until stop 132 engages the guide pin 130 and pivots lever 124. The actual movement is very slight and, through a linkage mechanism, causes retaining flaps 94 to swing out to release the bill held in the escrow box. An adjacent chute or other means, not shown, returns the ejected bill to the donor.

The linkage mechanism comprises a connecting rod 134 attached to lever 124 above the pivot 136 of the lever, the connecting rod extending to a bellcrank 138 mounted on a bearing 139 below top panel 82. Flap 94 has an outwardly projecting arm 140 which is coupled by pivotal links 142 and 144 to the bellcrank 138. When lever 124 is moved by contact with stop 132, the bellcrank, through links 142 and 144, pushes arm 140 down and raises flap 94, as in the broken line position in FIG. 4. A spring 146 connected between lever 124 and frame 92 biases the linkage to hold flap 94 closed.

Figure 11:
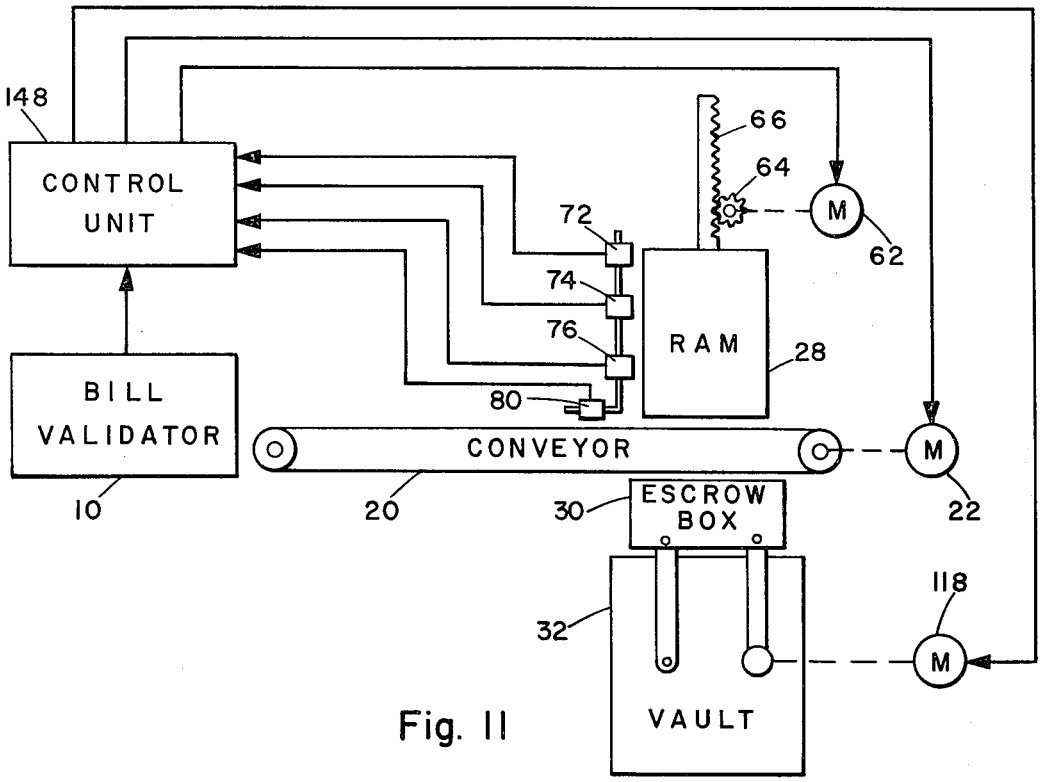
FIG. 11 is a diagram of the actuating system of the apparatus.
Figure 12:
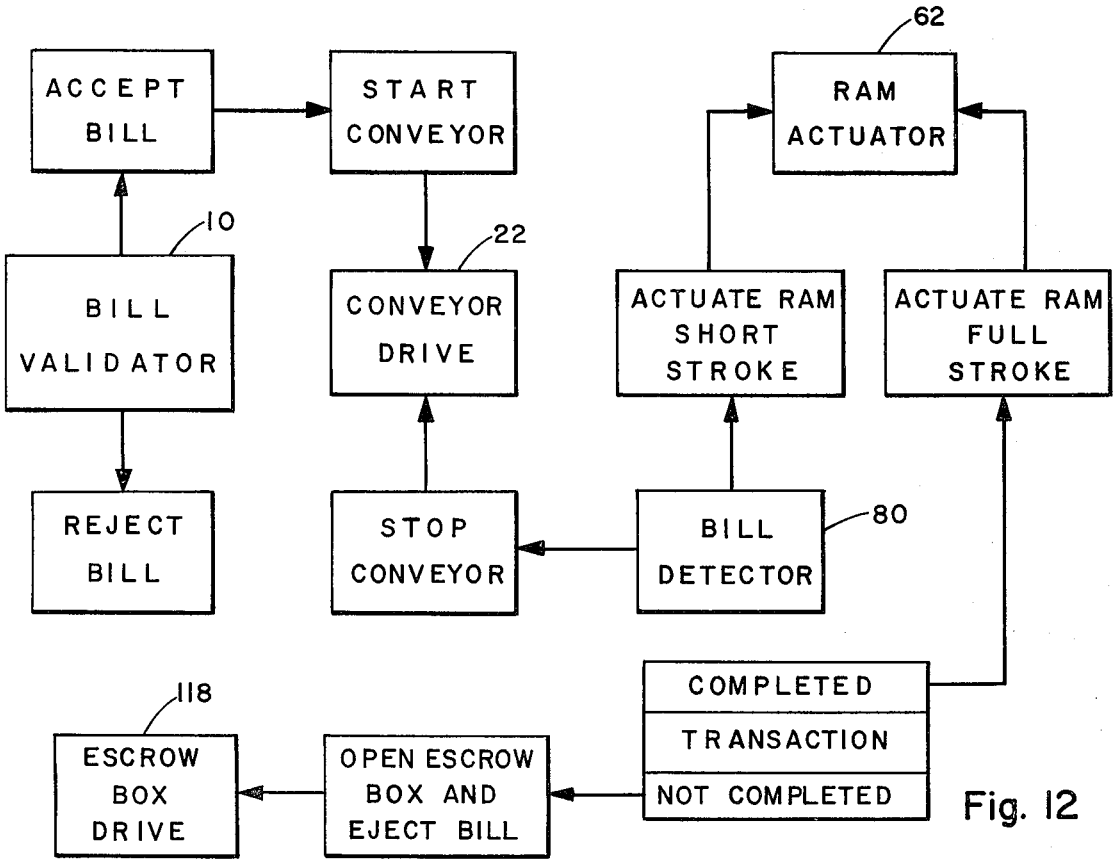
FIG. 12 is a block diagram of the related functions of the apparatus.

The operation of the apparatus can best be followed by reference to FIGS. 1, 11 and 12. The control unit 148 shown in FIG. 11 can be a simple electrical switching arrangement since all operations involve on and off switching actions controlled by limit switches or sensors. In most instances, however, the control unit would be part of the overall control system of the machine in which the apparatus is installed.

When a bill is inserted in the validator unit 10, it is either accepted or rejected. A rejected bill is returned and no action occurs in the machine. An accepted bill emerges from the rear outlet 12 of the validator unit into track 14. The validator unit normally contains switching means for starting associated mechanism in the machine, and this may be used to start conveyor drive motor 22. If no such switch means exists, it would be a simple matter to install a photoelectric sensor at the exit of the validator, to start the conveyor when a bill emerges. The bill is caught by belts 20 and moved along track 14 to the handling station 24. Very little pressure is needed, a slightly roughened surface on the belts being sufficient to grip and slide the bill along the track.

Sensor 80 detects the passage of the bill and causes the conveyor drive motor 22 to stop and ram actuator motor 62 to start. The action may be delayed slightly after detecting the leading edge of the bill, or instantaneous after detecting the trailing edge of the bill, depending on the type of control system used in the basic machine. For the short stroke of the ram 28, sensor 74 detects passage of the upper edge of the ram and reverses motor 62 to return the ram to the raised position, sensor 72 providing the upper limit stop control.

Figure 4:
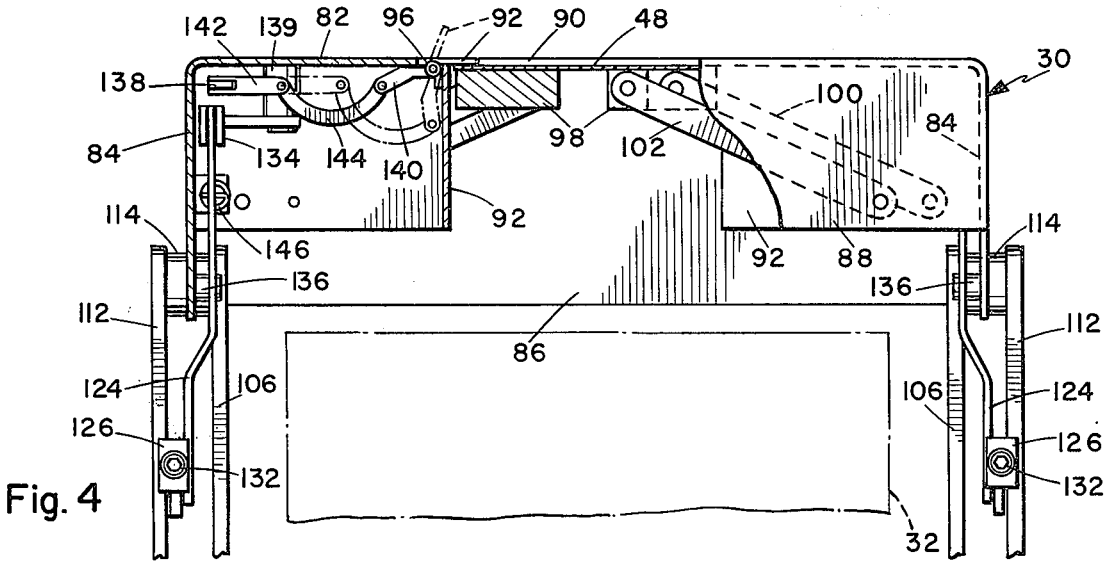
FIG. 4 is an end view of the escrow box, partially cut away, as taken from the right hand side of FIG. 3.
Figure 9:
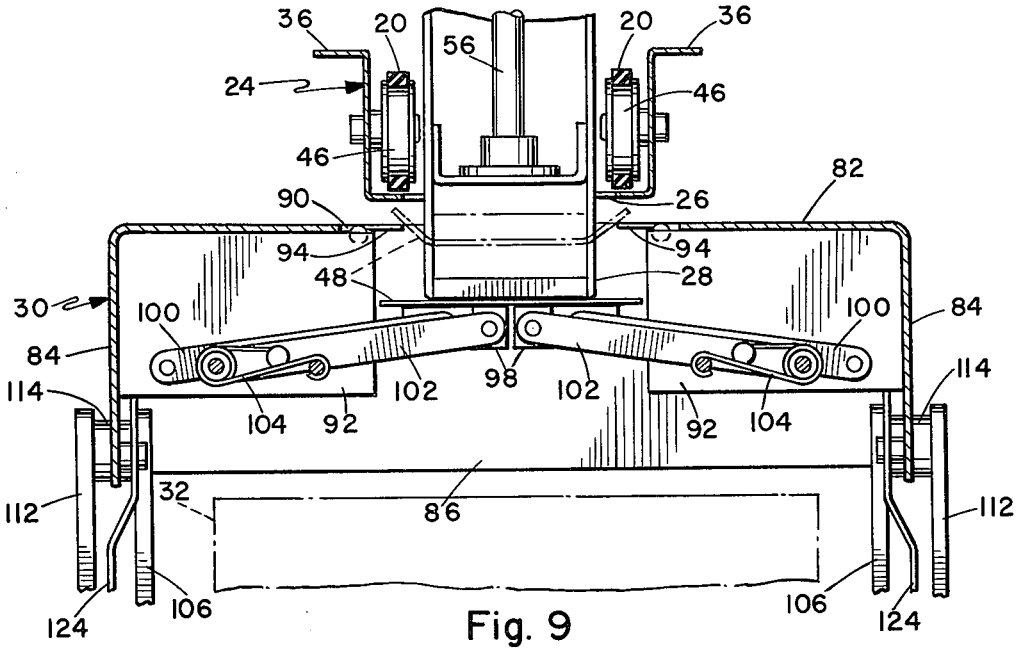
FIG. 9 is a sectional view taken on line 9—9 of FIG. 3, showing the initial ram action.

The short stroke ram action transferring the bill to the escrow box, is illustrated in FIG. 9. The bill 48 is forced downwardly through opening 26 in the track and between flaps 94 into the escrow box, the longitudinal edges of the bill bending back as indicated in the broken line position. Platens 98 are pressed down by the ram action and, when the ram returns, the platens lift the bill and hold it against the underside of flaps 94. FIG. 4 shows a bill stored in escrow in this position until the machine completes the selected transaction.

Figure 10:
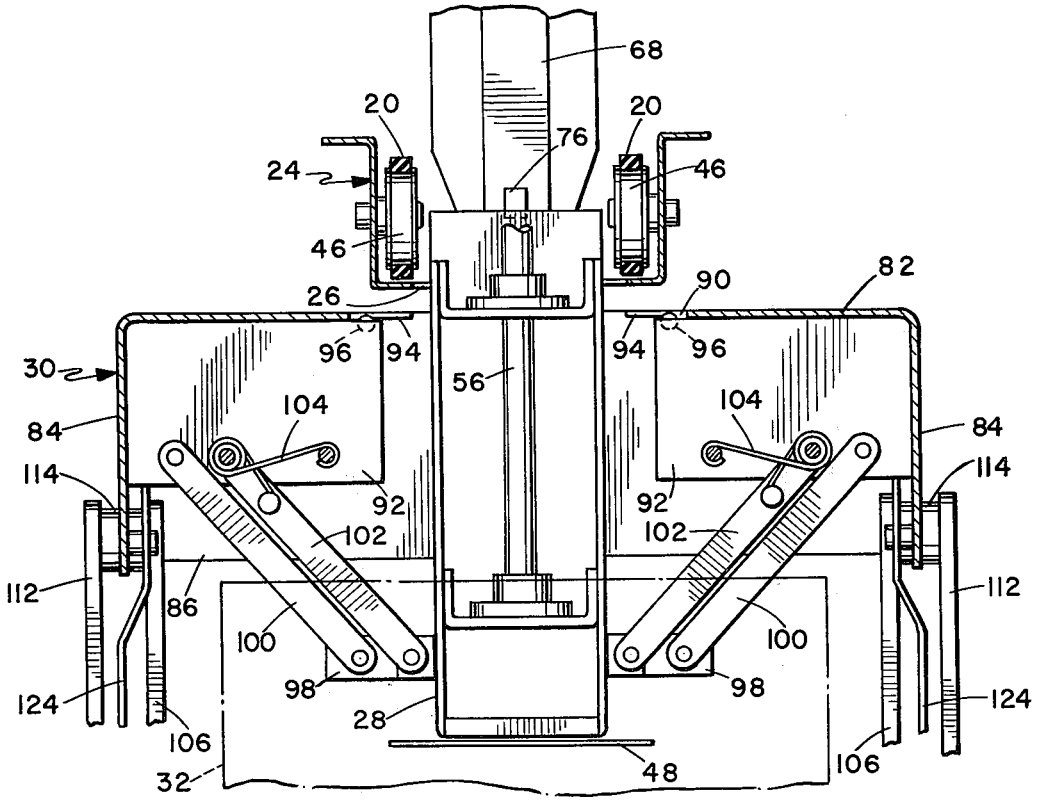
FIG. 10 is a sectional view similar to FIG. 9, but showing the full ram stroke.

If the transaction is completed, as by the machine correctly delivering merchandise, a ticket, change, or other items of value, the ram is initiated to make a full stroke. The means for determining whether or not the machine has functioned correctly is normally incorporated in the basic machine and could easily be adapted to provide the necessary control functions. In making a full stroke, the ram descends until its passage is detected by the lower sensor 76. This position is illustrated in FIG. 10, in which the ram 28 is driven down far enough to push the bill 48 down between the platens 98, which are separated by the ram. The bill can then drop into the vault and be stored. When the ram is retracted, the platens return to their normal position under flaps 94.

If a transaction is not completed, as when the machine does not have the required item of value or is out of change the escrow box drive motor 118 is actuated to swing the escrow box forward and down and eject the bill for return to the donor. When the escrow box reaches the lowered position and flaps 94 are opened by the stop actuated linkage to release the bill, arm 112 actuates sensor 122 and causes motor 118 to be reversed. The escrow box is then returned to its position below handling station 24, ready for the next transaction, sensor 120 shutting off motor 118 when the upper position of arm 112 is reached.

Due to the very short path of travel of the bills, with minimum restriction, the apparatus is capable of reliable operation for prolonged periods. It should be understood that the specific linkages shown are exemplary and other mechanical equivalents may be equally suitable.

Having described my invention, I claim:

1. Bill escrow and storage apparatus, comprising:

a validator unit for validating paper money bills and having an outlet through which each accepted bill is ejected;

a track attached to said validator unit to receive bills therefrom, said track being elongated and having a handling station spaced from the validator unit;

conveyor means mounted in said track for moving a bill from the validator unit to said handling station;

an escrow box mounted adjacent said handling station;

said escrow box having retaining means for holding a bill therein;

transfer means mounted at said handling station for transferring a bill from said track into said escrow box;

a vault mounted adjacent said escrow box;

actuating means coupled to said transfer means for selectively transferring a bill into said escrow box and from said escrow box into said vault;

ejection means coupled to said escrow box for selectively ejecting a bill therefrom;

said track has an opening therein at said handling station;

said transfer means comprising a ram reciprocally movably mounted on the side of the track opposite said escrow box;

and said actuating means driving said ram through the opening to push a bill from said track into said escrow box.

2. Apparatus according to claim 1, wherein said ejection means includes means for moving said escrow box clear of said track and releasing said retaining means.

3. Apparatus according to claim 1, wherein said escrow box is between said track and said vault;

said actuating means having control means for selectively driving said ram through a short stroke into the escrow box, and through a long stroke through the escrow box into said vault.

4. Apparatus according to claim 3, and including sensing means for sensing the passage of a bill into said handling station and initiating operation of said ram actuating means for the short stroke action.

5. Apparatus according to claim 3, wherein said escrow box has a pivotal swinging attachment to said vault;

said pivotal attachment including spaced arms pivotally connected to said escrow box and said vault, one of the arms being longer than the other, whereby the escrow box is at least partially inverted when swinging away from said track;

said ejection means including swinging drive means coupled to one of said arms.

6. Apparatus according to claim 5, wherein said ejection means further includes linkage coupled bertween said arms and said retaining means for releasing the retaining means when the escrow box is swung away from the track.

7. Apparatus according to claim 1, wherein said escrow box has a top panel with a bill receiving opening therein;

said retaining means including a pair of flaps hinged along opposite sides of said opening to overlap the edges of a bill therein, and platens pivotally mounted in the escrow box and biased against said flaps to hold a bill therebetween.

8. Apparatus according to claim 7, wherein said flaps are normally substantially flush with said top panel;

said ejection means including actuating means coupled to said flaps for raising the flaps clear of said platens.

9. Apparatus according to claim 8, wherein said escrow box has an open bottom portion, said vault being positioned below the open bottom portion;

spaced arms pivotally connecting said escrow box to said vault to swing outwardly therefrom clear of said track;

said ejection means including swinging drive means coupled to said arms.

10. Apparatus according to claim 9, wherein said arms include two pair of arms on opposite sides of the escrow box, one pair being longer than the other, whereby the escrow box is at least partially inverted when swinging away from the track.

11. Apparatus according to claim 10, wherein said ejection actuating means includes linkage connected between said arms and said flaps to raise said flaps when the escrow box is swung outwardly from the vault.

12. Apparatus according to claim 9, and including control means coupled to said ram actuating means for selectively driving the ram through a short stroke into said escrow box, and through a long stroke through the escrow box into said vault.

* * * * *